United States Patent [19]

Donnelly

[11] Patent Number: 4,936,134

[45] Date of Patent: Jun. 26, 1990

[54] RIVET-SETTING TOOLS AND GRIPPING JAWS THEREFOR

[75] Inventor: Robert J. Donnelly, Sutton Coldfield, England

[73] Assignee: Emhart Industries, Inc., Hartford, Conn.

[21] Appl. No.: 392,627

[22] Filed: Aug. 11, 1989

[51] Int. Cl.[5] ..... B21J 15/38

[52] U.S. Cl. ..... 29/243.527

[58] Field of Search ..... 72/391, 453.17, 453.19, 72/114; 29/243.53

[56] References Cited

U.S. PATENT DOCUMENTS

| | | | |
|---|---|---|---|
| 2,438,201 | 3/1948 | Buchet | 72/391 |
| 3,157,305 | 11/1964 | Baugh | 72/391 |
| 3,792,933 | 2/1974 | Stencel | 72/391 |
| 3,850,021 | 11/1974 | Binns | 72/391 |
| 4,059,980 | 11/1977 | Nance | 72/391 |
| 4,489,471 | 12/1984 | Gregory | 29/243.52 |

*Primary Examiner*—David Jones

*Attorney, Agent, or Firm*—Spencer T. Smith

[57] ABSTRACT

A rivet-setting tool for pull-to-set blind rivets having mandrel-gripping jaws in which the teeth are widely-spaced at a level of only 8–15 teeth per inch; preferably the teeth in each jaw have non-uniform spacing, the spacing between some pairs of teeth being at least twice the spacing of the pairs of teeth in the same jaw; preferably, also, each tooth in one jaw is located directly opposite a tooth in the other jaw.

3 Claims, 2 Drawing Sheets

RIVET-SETTING TOOLS AND GRIPPING JAWS THEREFOR

The present invention relates to rivet-setting tools for blind rivets of the pull-to-set type, and in particular to the gripping jaws of such tools.

BACKGROUND OF THE INVENTION

Pull-to-set blind rivets are set from one side of a workpiece to be riveted by inserting the flanged body of a blind rivet into a hole and collapsing the body of the rivet on the blind side of the hole by pulling on the projecting mandrel. The mandrel is gripped between the jaws of the setting tool and the pressure of grip required depends on a number of factors, including the ductility of the material of the rivet body and the hardness of the material used for the mandrel.

With improved technology, blind rivets are produced from much more difficult materials than hitherto, including mandrels made from very hard materials such for example as stainless steel. With hard material mandrels and less ductile rivet bodies, a much higher grip is required for the jaws of a setting tool if slipping is to be avoided.

It is accordingly an object of the present invention to provide a rivet-setting tool with gripping jaws with a reduced tendency to slip.

A gripping jaw for a rivet-setting tool is usually provided with a row of closely-spaced serrations, ridges or teeth in each of a pair of jaws which are applied symmetrically to the mandrel of a blind rivet. The teeth are usually provided at the rate of 30–40 teeth per inch so that a typical jaw 0.3 inch long has 10 or 11 teeth. When the tool is operated, the mandrel is gripped by the jaws and pulled into the blind end of the rivet body.

SUMMARY OF THE INVENTION

According to the present invention, in a rivet-setting tool for pull-to-set blind rivets the mandrel-gripping jaws are provided with widely spaced teeth in each jaw, the teeth being provided at the rate of only 8–15 per inch. Thus the 0.3 inch jaw has only 3 or 4 teeth instead of the 10 or 11 teeth used hitherto. Preferably the jaws are provided with vari-spaced teeth, that is, in which the teeth in each jaw have non-uniform spacing. That is to say, with non-uniform spacing of the teeth, the separation of some pairs of teeth in each jaw is greater than the spacing of other pairs of teeth in the jaw. Preferably the greater spacing is achieved by the omission of at least one tooth so that the spacing between some pairs of teeth in a jaw is at least twice the spacing between other pairs of teeth in the same jaw.

In the rivet setting tool according to the invention, since the number of teeth in each jaw is reduced, the load on the tool is concentrated on less teeth and thus the load per tooth is increased to give a heavier 'bite'.

In a rivet-setting tool according to the present invention, although the teeth in one jaw may be spaced differently one from another, they are preferably located symmetrically in the two jaws of the tool with each tooth in one jaw located directly opposite a tooth in the other jaw. Additionally, the extra gap between the teeth in the mandrel-gripping jaw provides extra space for the escape of detritus produced by the operation of the tool so that it remains cleaner than known tools and operates effectively for longer periods between cleaning requiring cessation of the riveting operation. Such detritus originates, for example, by removal of small amounts of plating from plated jaws and/or plated rivet mandrels.

In order that the invention be better understood, a preferred embodiment of the invention will now be described by way of example in greater detail with reference to the accompanying drawings in which:

DETAILED DESCRIPTION OF THE DRAWINGS

Figure 1:
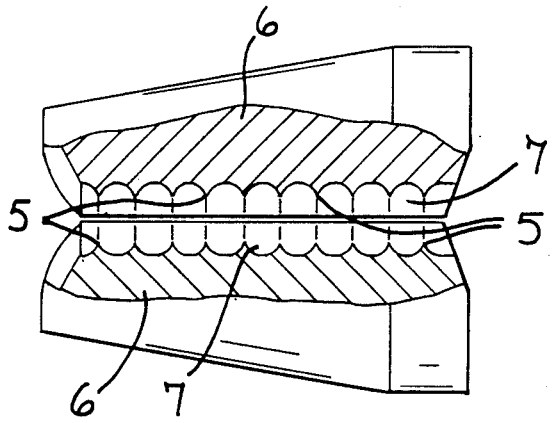
FIG. 1 is a diagrammatic section of a pair of gripping jaws of a conventional rivet-setting tool.

In FIG. 1, pulling teeth 5 are arranged regularly along jaws 6 of a conventional rivet-setting tool, with only tiny gaps 7 between closely-spaced teeth 5.

Figure 2:
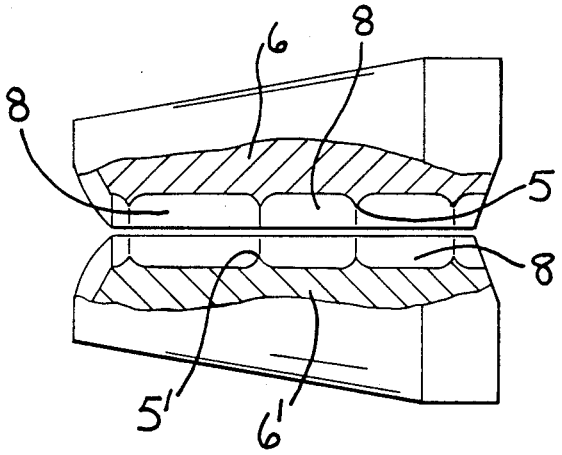
FIG. 2 is a diagrammatic section of a pair of parallel gripping jaws in a tool according to the invention.
Figure 3:
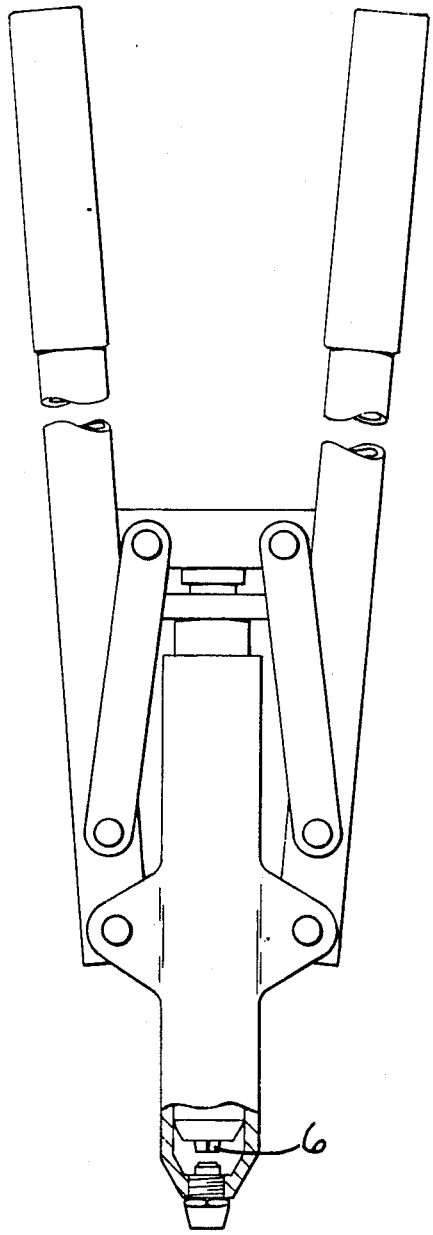
FIG. 3 is a plan-view representation of a tool according to the invention, and incorporating gripping jaws as shown in FIG. 2.

FIG. 2 illustrates a pair of jaws according to the invention in which the gaps 8 separating pulling teeth 5,5' are non-uniform so that the separation of one pair of teeth 5,5' is different from the separation of another pair of teeth 5 in the same jaw 6,6' so that the arrangement of teeth in each jaw 6,6' is said to be vari-spaced. The teeth 5 in jaw 6 are located directly opposite teeth 5' in jaw 6' so that the jaws close symmetrically over a rivet mandrel.

The concentration of the load applied to the tool on only a few teeth results in a great improvement of the grip of the jaws on a rivet mandrel and greatly reduces slipping, even when operating with very hard mandrels, such as stainless steel. The increased gap between the teeth also assists the egress of detritus such as plating or mandrel material thrown up by the gripping operation so that the wide-spaced-tooth jaws of the invention are less prone to fouling during the riveting operation.

I claim:

1. In a rivet setting tool for pull-to-set blind rivets, mandrel-gripping jaws are provided with widely-spaced teeth at the rate of only 8–15 per inch, said teeth extending outwardly from said jaws an equal distance and the teeth being uniformly spaced along each jaw.

2. A rivet-setting tool according to claim 1 wherein some pairs of teeth in a jaw have at least twice the spacing as the spacing between other pairs of teeth in the same jaw.

3. A rivet setting tool according to claim 1 wherein each tooth in one jaw is located directly opposite a tooth in the other jaw.

* * * * *